US008808120B2

(12) United States Patent
Cain

(10) Patent No.: US 8,808,120 B2
(45) **Date of Patent: *Aug. 19, 2014**

(54) BAMBOO LACROSSE SHAFT

(75) Inventor: Paul Cain, Arnold, MD (US)

(73) Assignee: Bamshaft, Inc., Arnold, MD (US)

( * ) Notice: Subject to any disclaimer, the term of this patent is extended or adjusted under 35 U.S.C. 154(b) by 248 days.

This patent is subject to a terminal disclaimer.

(21) Appl. No.: 13/069,049

(22) Filed: Mar. 22, 2011

(65) Prior Publication Data

US 2011/0250995 A1 Oct. 13, 2011

Related U.S. Application Data

(60) Provisional application No. 61/334,062, filed on May 12, 2010, provisional application No. 61/322,128, filed on Apr. 8, 2010.

(51) Int. Cl.
*A63B 59/02* (2006.01)
*A63B 65/12* (2006.01)

(52) U.S. Cl.
CPC ..... *A63B 59/02* (2013.01)
USPC ..... 473/513; 473/512; D21/724

(58) Field of Classification Search
USPC ..... 473/505, 513; D21/724
See application file for complete search history.

(56) References Cited

U.S. PATENT DOCUMENTS

| | | | | |
|---|---|---|---|---|
| 1,450,646 | A * | 4/1923 | Sadenwater | 473/564 |
| 3,702,702 | A * | 11/1972 | Hoult | 473/513 |
| 5,476,706 | A * | 12/1995 | Shimizu | 428/136 |
| 5,490,669 | A * | 2/1996 | Smart | 473/564 |
| 6,827,659 | B1 * | 12/2004 | Chen | 473/564 |
| 6,916,261 | B2 * | 7/2005 | Cullen et al. | 473/563 |
| 2007/0270255 | A1 * | 11/2007 | Morrow et al. | 473/513 |
| 2011/0250995 | A1 * | 10/2011 | Cain | 473/513 |
| 2013/0005516 | A1 * | 1/2013 | Cain | 473/513 |

OTHER PUBLICATIONS

Webpage download, Inside Lacrosse, 2005,forums.insidelacrosse.com/showthread.php?28100-Making-a-Wooden-Shaft, 8 pages.*
Webpage download, hikstik'2008, 2008,web.archive.org/web/20080421105636/http://www.hikstik.com/prototypes.html, 4 pages.*
Webpage download, NCAA Lacrosse Rules, 2008,www.uslacrosse.org/the_sport/mens_rules.phtml, 2 pages.*
Webpage download, ScrapWood, 2013, www.instructables.com/id/Scrap-Wood-Cutting-Board-2/, 8 pages.*
www.hikstik.com web archive Nov. 18, 2009-Feb. 8, 2011.

* cited by examiner

*Primary Examiner* — Gene Kim
*Assistant Examiner* — M Chambers
(74) *Attorney, Agent, or Firm* — Steptoe & Johnson LLP

(57) ABSTRACT

Bamboo lacrosse shafts and methods of manufacturing bamboo lacrosse shafts are disclosed.

21 Claims, 6 Drawing Sheets

BAMBOO LACROSSE SHAFT

CLAIM FOR PRIORITY

This application claims priority under 35 U.S.C. §119(e) to Provisional U.S. Patent Application Ser. No. 61/322,128 filed on Apr. 8, 2010 and Provisional U.S. Patent Application Ser. No. 61/334,062 filed on May 12, 2010, which are hereby incorporated by reference.

TECHNICAL FIELD

This invention relates to a bamboo shaft for a lacrosse stick.

BACKGROUND

When playing lacrosse, it is desirable to have a shaft that is strong, flexible, and has a good feel to the player. In addition, when playing in cold weather, it can be desirable to have a shaft that thermally insulates a player's hands.

SUMMARY

Lacrosse is played with a long-handled instrument known as a lacrosse stick. The lacrosse stick includes a head attached to a shaft. A player uses the stick to control the ball and to strike opposing players. Lacrosse shafts may be constructed from any suitable material including wood, metal, plastic, or fiberglass. Historically, lacrosse sticks were often constructed from hickory and other hardwoods. More recently, aluminum, titanium, scandium or other metals, including alloys, have been employed. Metal shafts offer superior shear and tensile strengths compared to various wooden shafts. Unfortunately, metal shafts lack sensitivity. For instance, a player may prefer the way a wooden shaft transmits vibrations to their hands, thereby providing improved feel while controlling the ball. Players may also prefer the way a wooden shaft insulates their hands when playing in cold weather. Conversely, a metal shaft acts as a heat sink and strips heat from the player's hands. To overcome disadvantages of prior lacrosse shafts while retaining certain advantages, a new bamboo lacrosse shaft has been developed and is set forth herein.

Throughout the world, bamboo is gaining popularity as a construction material primarily due to its rapid growth rates and impressive material properties. For instance, under optimal conditions, bamboo may grow up to 48 inches in a 24 hour period making it one of the fastest growing plants on earth. As a result of this rapid growth, bamboo is typically ready for harvesting after only 2-3 years of life. In addition to rapid growth rates, bamboo also has impressive material properties due to strong fibers which provide longitudinal reinforcement. For instance, the tensile and shear strengths of bamboo may exceed those of aluminum. In addition to having great strength, bamboo also boasts surprising flexibility. Because of these attributes, bamboo is an excellent material for a lacrosse shaft.

Before bamboo can be incorporated into a lacrosse shaft, it must undergo several processes. First, the bamboo must be harvested and split open to expose the internal membranes. Next, the internal membranes and external nodes must be removed. Then, the sugars must be removed from the bamboo to improve its resistance to warping and cracking over time. Also, if the sugars are not removed, the bamboo may be vulnerable to insect infestation. To remove the sugars, various processes may be used. For instance, the bamboo may be treated with pressurized steam in an autoclave. During this process, steam penetrates the cells of the bamboo and forces sugars out of the cells. Alternately, the bamboo may be placed into a chemical bath of sodium hydroxide to accomplish the same objective. Next, the sections of bamboo may be pressed flat to create layers. As a result of the sugar extraction step, the moisture content of the bamboo layers is high at this stage in the process. This high moisture content is an advantage during pressing, since the layers are more resistant to cracking. However, high moisture levels are not desirable when constructing a lacrosse shaft since the excess moisture can interfere with performance of adhesives used to join layers of bamboo. Therefore, the bamboo layers must be adequately dried before joining.

Once the layers have been dried and squared, they are ready for incorporation into a shaft. A typical shaft ranges from 30 to 72 inches depending on the player's position, and the width and thickness are typically about ⅞ inch and 1 inch, respectively. However, women and children may prefer smaller dimensions. Since a single processed bamboo layer is typically too thin to form a shaft by itself, it is necessary to join several layers of bamboo to achieve the desired width and thickness. For instance, a first bamboo layer may be joined to a second bamboo layer and a third bamboo layer. Depending upon the desired thickness of the shaft, a fourth and fifth bamboo layer may also be added. Similarly, additional bamboo layers may be added to achieve desired characteristics such as thickness, strength, mass, etc.

Bamboo layers may be joined by applying an adhesive along their mating surfaces. The adhesive may include epoxy, wood glue, etc. Once the adhesive is applied, the bamboo layers may be secured with clamps or bands until the adhesive has cured. If a heat-activated adhesive is used, the bundles of bamboo layers may be introduced to a kiln. Once the adhesive has cured and the bundles have cooled, the bundles may be machined to achieve an octagonal cross-section. For instance, the bundle may be fixed in place, and a milling bit may traverse the bundle from a first end to a second end to create flat surfaces along its length. Alternately, a belt sander may be used to create flat surfaces along the length of the bundle. An octagonal cross section is desirable since it improves the player's grip on the shaft. Once the desired shaft profile is achieved, the shaft may be finished with hand sanding and by applying paint, varnish, and/or sealant. As a result of sanding, the edges of the octagonal shaft may become rounded.

A bamboo lacrosse shaft having lamination planes in both horizontal and vertical orientations is known. Conversely, the bamboo lacrosse shaft described herein includes lamination planes in only one orientation. As a result, fewer failure modes are present, so increased strength is attained. To quantify differences in strength between the known shaft and the shaft described herein, physical testing of sample shafts was completed. The first shaft was a bamboo lacrosse shaft purchased from HIKSTIK.COM, LLC in March of 2010. The second shaft was a bamboo lacrosse shaft as described herein sold under the trademark BAMSHAFT by Bamshaft, Inc., Annapolis, Md. During testing, each shaft was supported at both ends and a point load was applied to the midpoint of each shaft. As shown in FIG. 13, the bamboo HIKSTIK failed when 234 pounds were applied to its midpoint, whereas the BAMSHAFT resisted failure until 281 pounds were applied to its midpoint. Since the external dimensions of the shafts were identical, the greater strength of the BAMSHAFT is attributed to a superior design described herein. In particular, by arranging the bamboo layers to form only parallel lamination planes, the resulting shaft possesses greater strength than a bamboo shaft having lamination planes in multiple directions.

A lacrosse shaft may include a first end, a second end, a first side surface, and a second side surface. In addition, the shaft may include a first bamboo layer extending from the first end to the second end and extending substantially from the first side surface substantially to the second side surface. The shaft may also include a second bamboo layer extending from the first end to the second end. Similarly, the shaft may include a third bamboo layer extending from the first end to the second end. The first bamboo layer may be joined to the second bamboo layer along a first lamination plane that is substantially normal to the first side surface and substantially normal to the first end. The first bamboo layer may also be joined to the third bamboo layer along a second lamination plane that is substantially parallel to the first lamination plane. The shaft may have an octagonal cross section normal to the first lamination plane and normal to the first side surface.

The first bamboo layer may include a width and a thickness, where the width is between 0.5 and 1.5 inches, and the thickness is between 0.0625 and 0.5 inches. More preferably, the width may be between 0.75 and 1.25, and the thickness may be between 0.125 to 0.375 inches.

With respect to width, the second bamboo layer may extend substantially from the first side surface substantially to the second side surface. Similarly, the third bamboo layer may extend substantially from the first side surface substantially to the second side surface. The shaft may also include a fourth bamboo layer joined to the second bamboo layer along a third lamination plane that is substantially parallel to the first lamination plane. Similarly, a fifth bamboo layer, may be joined to the third bamboo layer along a fourth lamination plane that is substantially parallel to the first lamination plane.

Alternately, a lacrosse shaft may include a first end, a second end, a top surface, and a bottom surface. In addition, the shaft may include a first bamboo layer extending from the first end to the second end and extending from the top surface to the bottom surface. Similarly, the shaft may include a second bamboo layer extending from the first end to the second end. Also, the shaft may include a third bamboo layer extending from the first end to the second end. The first bamboo layer may be joined to the second bamboo layer along a first lamination plane that is substantially normal to the top surface and substantially normal to the first end. The first bamboo layer may also be joined to the third bamboo layer along a second lamination plane that is substantially parallel to the first lamination plane.

A method of manufacturing a lacrosse shaft may include providing first bamboo layer having a first end, a second end, a first side surface, and a second side surface. Next, the method may include providing a second bamboo layer extending from the first end to the second end. Then, the method may include providing a third bamboo layer extending from the first end to the second end. Subsequently, the method may include joining the first bamboo layer to the second bamboo layer along a first lamination plane that is substantially normal to the first end and is substantially normal to the first side surface. Also, the method may include joining the first bamboo layer to the third bamboo layer along a second lamination plane that is substantially parallel to the first lamination plane. Finally, the method may include machining the bamboo layers to produce an octagonal cross section.

DETAILED DESCRIPTION

Figure 1:
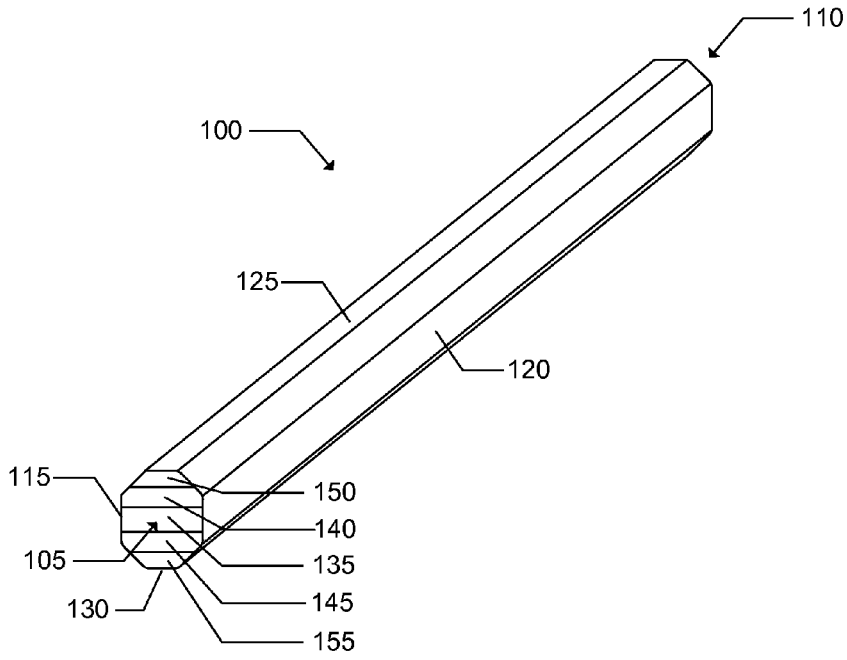
FIG. 1 is a perspective view of a bamboo lacrosse shaft.
Figure 2:
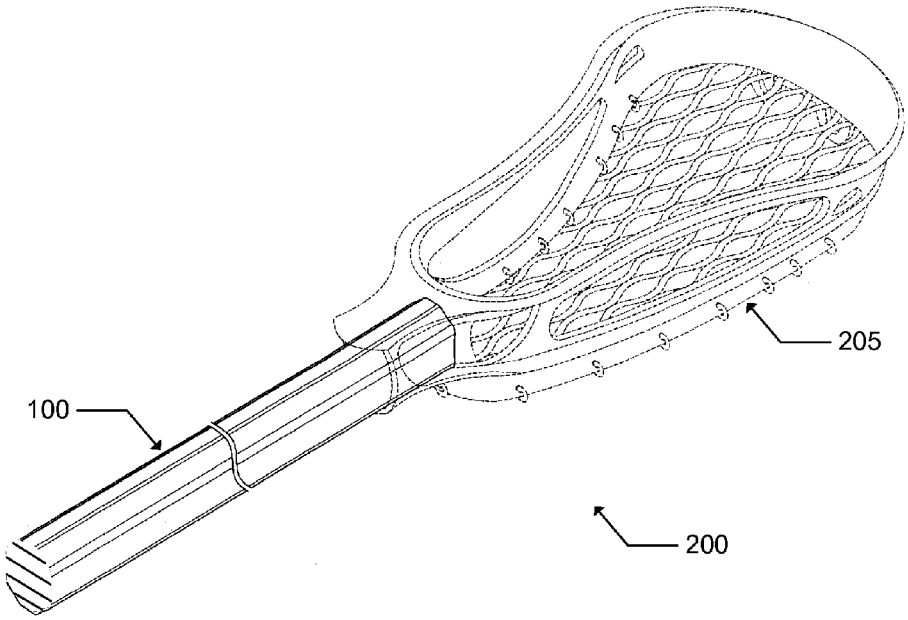
FIG. 2 is a side view of a lacrosse stick comprising a bamboo shaft and head.

As shown in FIG. 2, a lacrosse stick 200 may include a lacrosse head 205 attached to a bamboo lacrosse shaft 100. As shown in FIG. 1, the bamboo shaft 100 may include a first end 105, a second end 110, a first side surface 115, a second side surface 120, a top surface 125, and a bottom surface 130. The shaft may also include a first bamboo layer 135 extending from the first end 105 to the second end 110 and extending from the first side surface 115 to the second side surface 120. Alternately, the first bamboo layer 135 may extend substantially from the first side surface 115 substantially to the second side surface 120. For instance, the first bamboo layer 135 may begin within 0.25 inches of the first side surface 115 and extend toward the second side surface, ending within 0.25 inches from the second side surface 120.

Figure 3:
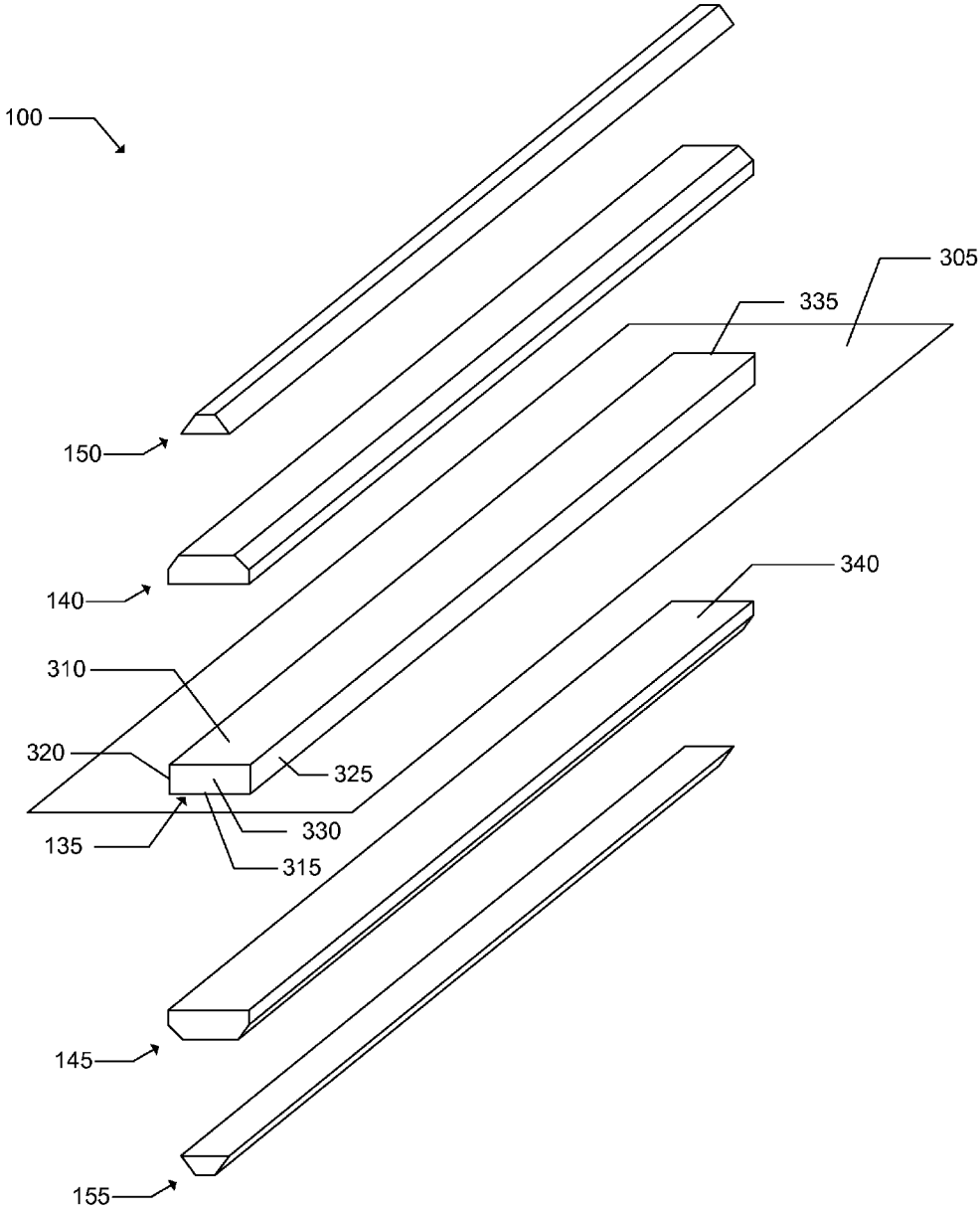
FIG. 3 is an exploded view of a bamboo lacrosse shaft.

As shown in FIG. 3, the first bamboo layer 135 may include a top surface 310, a bottom surface 315, a first side surface 320, a second side surface 325, a first end 330, and a second end 335. The width of the first bamboo layer is the shortest distance between the first side surface 320 and the second side surface 325. Likewise, the thickness of the first bamboo layer 135 is the shortest distance between the top surface 310 and the bottom surface 315. The length of the first bamboo layer 135 is the shortest distance between the first end 330 and the second end 335.

The outer dimensions of the bamboo layer 135 are constrained by the dimensions of the bamboo plant from which it is extracted. Depending on a player's personal preference, having a strong bamboo shaft may be desirable. Therefore, since fibers are more densely packed near the outer surface of the culm, it may be advantageous to extract the first bamboo layer 135 from the outer portion of the plant. However, if a player prefers a shaft with less strength and greater flex, the first bamboo layer 135 may be extracted from nearer the inner surface of the culm where fibers are less densely packed. In either case, the first bamboo layer 135 may include a width between 0.5 and 1.5 inches and a thickness between 0.0625 and 0.5 inches. More preferably, the width may be between 0.75 and 1.25, and the thickness may be between 0.125 to 0.375 inches. Although specific dimensions are discussed herein, they are not intended to limit the scope of the invention. Accordingly, the dimensions of the first bamboo layer may differ from those discussed.

Figure 6:
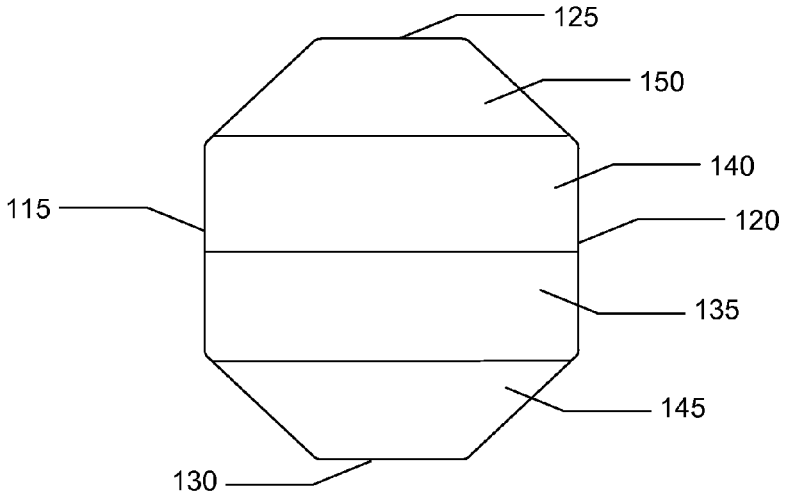
FIG. 6 is an end view of a bamboo lacrosse shaft.
Figure 7:
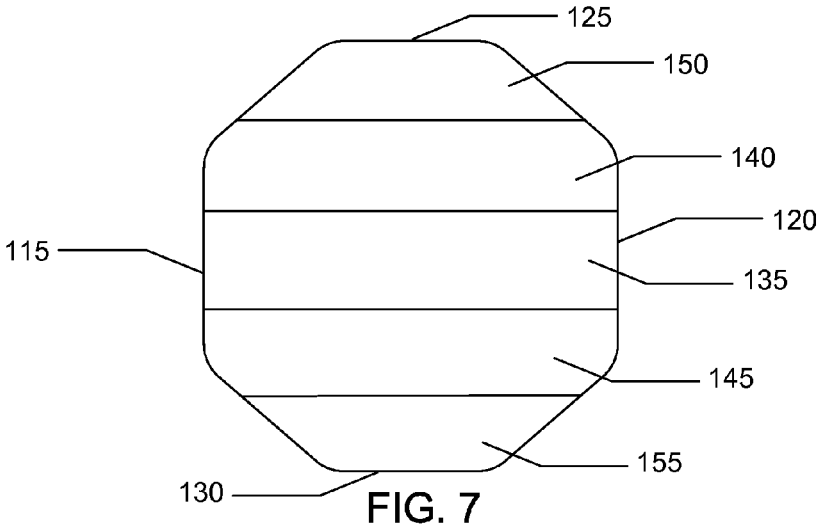
FIG. 7 is an end view of a bamboo lacrosse shaft.
Figure 8:
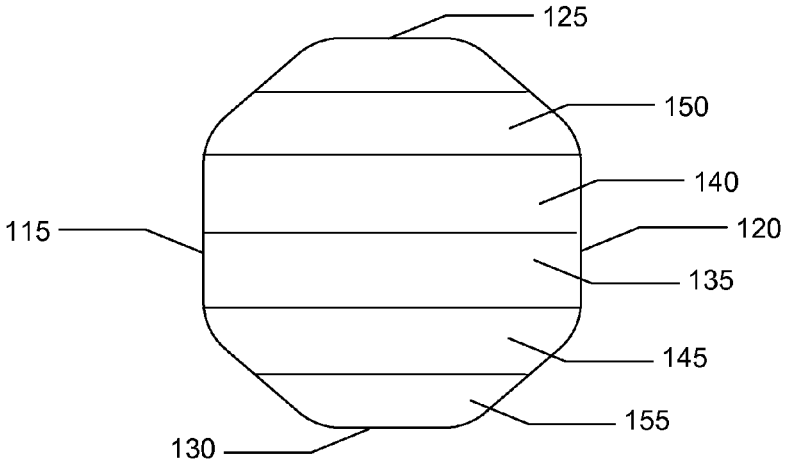
FIG. 8 is an end view of a bamboo lacrosse shaft.
Figure 9:
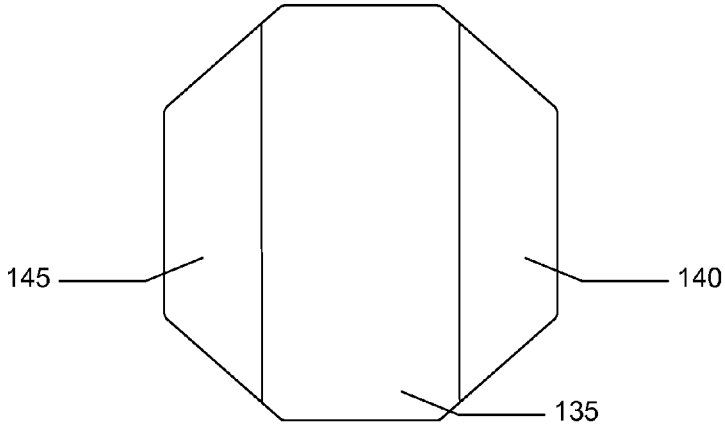
FIG. 9 is an end view of a bamboo lacrosse shaft.

As shown in FIG. 1, the shaft 100 may also include a second bamboo layer 145 extending from the first end 105 to the second end 110. The second bamboo layer may extend from the first side 115 to the second side 120 as shown in FIGS. 6, 7, and 8. However, in some configurations, the second bamboo layer 145 may have a width less than the width of the first bamboo layer 135. For instance, when the layers are oriented in a vertical configuration as shown in FIG. 9, the width of the second bamboo layer 145 (measured in the vertical direction) may be less than the width of the first bamboo layer 135 (measured in the vertical direction).

As shown in FIG. 3, the first bamboo layer 135 may be joined to a second bamboo layer 145 along a first lamination plane 305. The first lamination plane 305 may be substantially normal to the first side surface 115 and may be substantially normal to the first end 105. Prior to joining the layers, the surfaces may be prepped to improve adhesion. For instance, coarse sand paper may be used to roughen the surfaces thereby making them more receptive to an adhesive. Any suitable adhesive may be used, and the adhesive may be applied to one or both of the mating surfaces. Once adequately prepped, joining may be accomplished by mating the bottom surface 315 of the first bamboo layer to the top surface 340 of the second bamboo layer 145. To ensure proper alignment and adhesion, the bamboo layers may be constrained while the adhesive cures. For example, the bamboo layers may be temporarily clamped or banded together.

As shown in FIG. 2, the shaft 100 may also include a third bamboo layer 140 extending from the first end 105 to the second end 110. The third bamboo layer 140 may be joined to the first bamboo layer 135 along a second lamination plane (not shown) that is substantially parallel to the first lamination plane 305. Like the second bamboo layer 145, the third bamboo layer 140 may extend from the first side 115 to the second side 120 as shown in FIGS. 6, 7, and 8. However, in some configurations, the third bamboo layer 140 may have a width less than the width of the first bamboo layer 135. For instance, when the layers are oriented in a vertical configuration as shown in FIG. 9, the width of the third bamboo layer 140 (measured in the vertical direction) may be less than the width of the first bamboo layer 135 (measured in the vertical direction).

As shown in FIG. 2, the shaft 100 may also include a fourth bamboo layer 155 extending from the first end 105 to the second end 110. The fourth bamboo layer 155 may be joined to the second bamboo layer 145 along a third lamination plane (not shown) that is substantially parallel to the first lamination plane 305. The fourth bamboo layer 155 may not extend from the first side 115 to the second side 120. For instance, as shown in FIG. 7, the width of the fourth bamboo layer 155 may be less than the width of the first bamboo layer 135. In addition, the thickness of the fourth bamboo layer 155 may be less than the thickness of the first bamboo layer 135.

As shown in FIG. 2, the shaft 100 may also include a fifth bamboo layer 150 extending from the first end 105 to the second end 110. The fifth bamboo layer 150 may be joined to the third bamboo layer 140 along a fourth lamination plane (not shown) that is substantially parallel to the first lamination plane 305. The fifth bamboo layer 150 may have a width that is less than the width of the first bamboo layer 135. For instance, as shown in FIG. 7, the width of the fifth bamboo layer 155 may be less than the width of the first bamboo layer 135. In addition, the thickness of the fifth bamboo layer 155 may be less than the thickness of the first bamboo layer 135.

Figure 4:
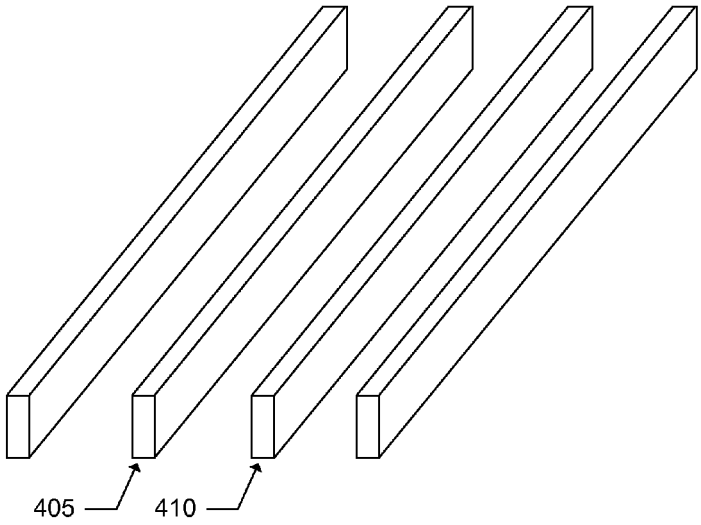
FIG. 4 is an exploded view of bamboo layers.
Figure 5:
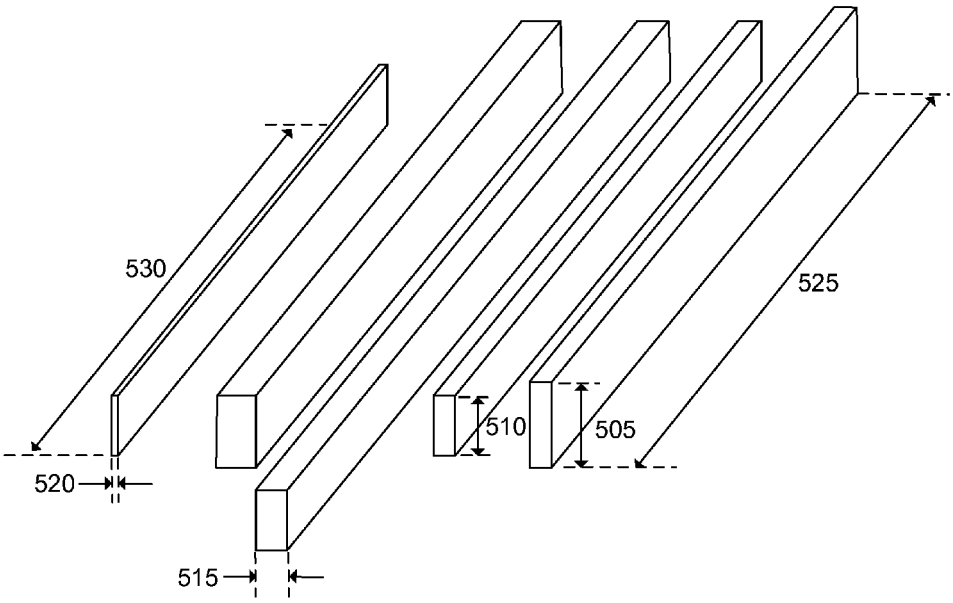
FIG. 5 is an exploded view of bamboo layers.

As shown in FIGS. 3, 4, and 5, the shaft 100 may be constructed from several bamboo layers joined together to form a bundle. To achieve an octagonal cross-section as shown in FIGS. 6-11, several methods may be employed. First, as shown in FIG. 3, appropriately shaped layers may be joined to form an octagonal cross-section. Second, as shown in FIG. 4, several similarly shaped bamboo layers (e.g. 405, 410) may be joined to form a bundle and then machined to create a octagonal cross-section. For example, as shown in FIG. 12, a rectangular bundle 1230 may be formed and machined along four edges (e.g 1235, 1240, 1245) to create eight surfaces along the length of the bundle. In particular, an end mill bit 1225 may be adjusted to a 45 degree angle relative to a vertical plane and traversed along the distance of the bundle to form a new surface 1205. Alternately, to form the new surface 1205, the bit 1225 may be held fixed and the bundle forced past the rotating bit. Similarly, three additional surfaces may be created by passing the bit along cut planes 1210, 1215, and 1220. By doing so, an octagonal cross-section is created.

Although the bamboo layers within the bundle 1230 may have similar dimensions, they may also differ. For instance, as shown in FIG. 5, the layers may have differing widths (e.g. 505, 510), thicknesses (e.g. 515, 520), and lengths (e.g. 525, 530). However, once the bamboo layers are joined, the bundle may be squared using an end mill, band saw, or other suitable process.

Figure 10:
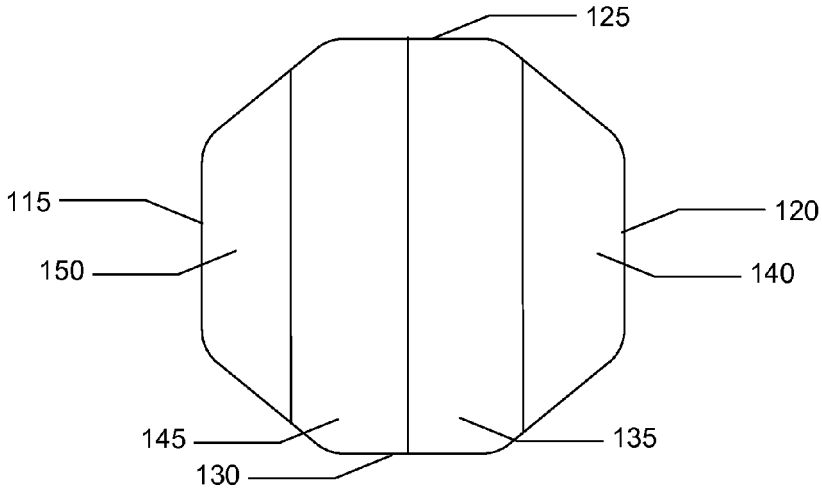
FIG. 10 is an end view of a bamboo lacrosse shaft.
Figure 11:
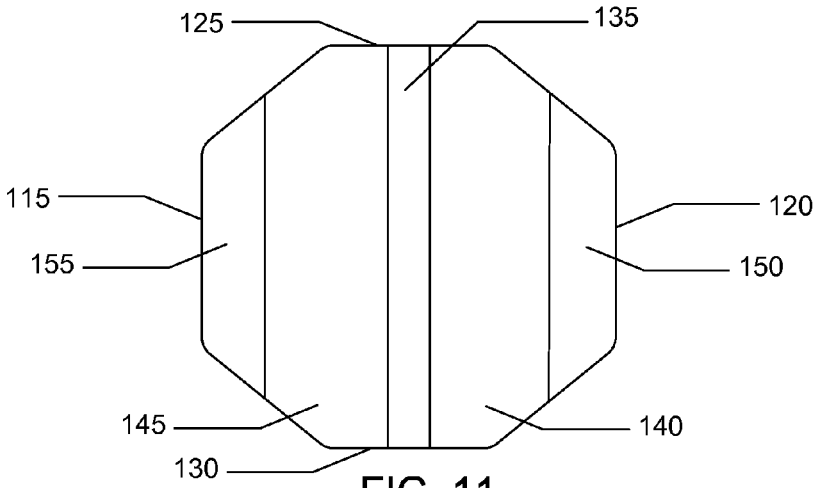
FIG. 11 is an end view of a bamboo lacrosse shaft.
Figure 12:
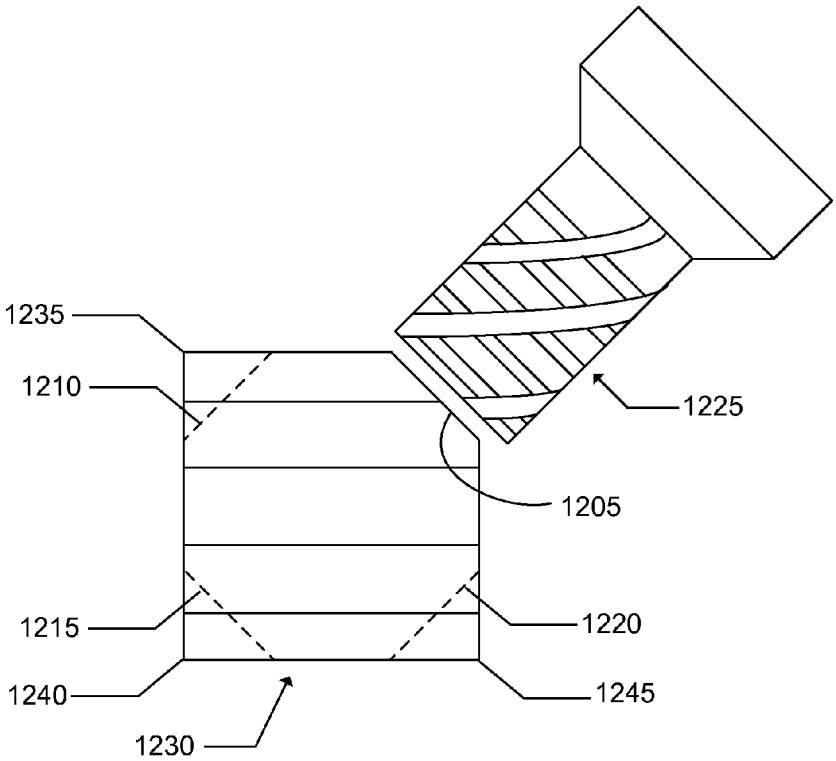
FIG. 12 is an end view of a bundle of bamboo layers and an end mill bit.
Figure 13:
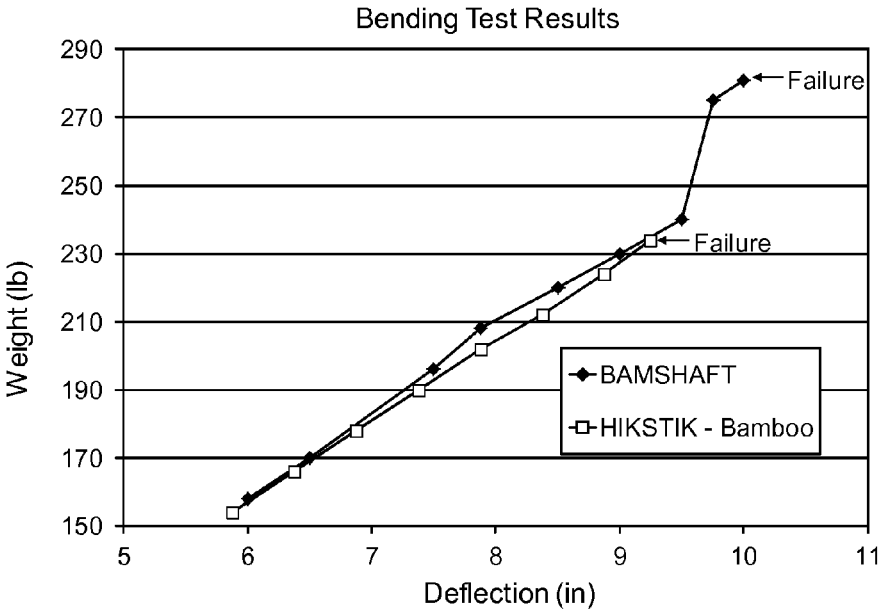
FIG. 13 is a chart showing bending test results for two bamboo lacrosse shafts.

FIGS. 6 through 11 show end views of example shafts. As shown in FIGS. 6-8, the layers may be oriented to form horizontal lamination planes. In particular, the layers may be arranged with lamination planes that are parallel to the top surface 125 and normal to the first end surface 105. Conversely, as shown in FIGS. 9-11, the layers may be oriented to form vertical lamination planes. In particular, the layers may be arranged with lamination planes that are normal to the top surface 125 and normal to the first end surface 110. Alternately, the lamination planes may appear in any orientation so long as the lamination planes are parallel. As described above, the number of bamboo layers comprising the shaft may differ. For instance, the shaft may have three or fewer layers as shown in FIG. 9, or the shaft may have six or more layers as shown in FIG. 8. Alternately, the shaft may have 4 or 5 layers as shown in FIGS. 6 and 7, respectively. In addition, the layers may have uniform thicknesses as shown in FIG. 6, or they may have differing thicknesses as shown in FIG. 11. In addition, the layers may be arranged symmetrically as shown in FIG. 11. Alternately, the layers may be arranged asymmetrically.

Details of one or more embodiments are set forth in the accompanying drawings and description. Other features, objects, and advantages will be apparent from the description, drawings, and claims. Although a number of embodiments of the invention have been described, it will be understood that various modifications may be made without departing from the spirit and scope of the invention. It should also be understood that the appended drawings are not necessarily to scale, presenting a somewhat simplified representation of various features illustrative of the basic principles of the invention.

What is claimed is:

1. A lacrosse shaft comprising:

a first end having an octagonal cross-section;

a second end opposite the first end;

a first side surface having a first length along a first edge of the octagonal cross-section;

a second side surface opposite the first side surface, the second side surface having a second length along a second edge of the octagonal cross-section;

a top surface having a third length along a third edge of the octagonal cross-section;

a bottom surface opposite the top surface, the bottom surface having a fourth length along a fourth edge of the octagonal cross-section, wherein the first and second lengths are longer than the third and fourth lengths; and a first bamboo layer extending substantially from the first side surface substantially to the second side surface, the first bamboo layer having a width between 0.5 and 1.5 inches, wherein a first surface of the first bamboo layer is joined to a first surface of a second bamboo layer along a first lamination plane substantially normal to the first side surface, substantially normal to the first end, and parallel to the top and bottom surfaces, wherein the second bamboo layer has a width less than the width of the first bamboo layer, wherein a second surface of the first bamboo layer is joined to a first surface of a third bamboo layer along a second lamination plane substantially parallel to the first lamination plane, wherein the third bamboo layer has a width less than the width of the first bamboo layer, wherein all lamination planes in a cross section perpendicular to a length of the shaft are oriented in the same direction and are substantially parallel, and wherein the shaft is configured to receive a lacrosse head.

2. The lacrosse shaft of claim 1, wherein the first bamboo layer comprises:

a thickness, wherein the thickness is between 0.0625 and 0.5 inches.

3. The lacrosse shaft of claim 1, wherein the first bamboo layer comprises:

a thickness, wherein the thickness is between 0.125 and 0.375 inches.

4. The lacrosse shaft of claim 1, wherein the second bamboo layer extends substantially from the first side surface substantially to the second side surface.

5. The lacrosse shaft of claim 1, wherein the third bamboo layer extends substantially from the first side surface substantially to the second side surface.

6. The lacrosse shaft of claim 1, further comprising:

a fourth bamboo layer, wherein a first surface of the fourth bamboo layer is joined to a second surface of the second bamboo layer along a third lamination plane substantially parallel to the first lamination plane.

7. The lacrosse shaft of claim 1, further comprising:

a fifth bamboo layer, wherein a first surface of the fifth bamboo layer is joined to a second surface of the third bamboo layer along a fourth lamination plane substantially parallel to the first lamination plane.

8. The lacrosse shaft of claim 1, wherein the first bamboo layer extends from the first end to the second end.

9. The lacrosse shaft of claim 1, wherein the second bamboo layer extends from the first end to the second end.

10. The lacrosse shaft of claim 1, wherein the third bamboo layer extends from the first end to the second end.

11. The lacrosse shaft of claim 1, wherein the shaft is configured to deflect inches.

12. The lacrosse shaft of claim 1, wherein the shaft is configured to withstand a load of 250 pounds.

13. A lacrosse shaft comprising:

a first end having an octagonal cross-section;

a second end opposite the first end;

a first side surface having a first length along a first edge of the octagonal cross-section;

a second side surface opposite the first side surface, the second side surface having a second length along a second edge of the octagonal cross-section;

a top surface having a third length along a third edge of the octagonal cross-section;

a bottom surface opposite the top surface, the bottom surface having a fourth length along a fourth edge of the octagonal cross-section, wherein the first and second lengths are longer than the third and fourth lengths; and a first bamboo layer extending substantially from the top surface substantially to the bottom surface, wherein the first bamboo layer has a width between 0.5 and 1.5 inches;

wherein a first surface of the first bamboo layer is joined to a first surface of the second bamboo layer along a first lamination plane substantially normal to the first side surface, substantially normal to the first end, and substantially parallel to the top and bottom surfaces;

wherein the second bamboo layer has a width less than the first bamboo layer, wherein a second surface of the first bamboo layer is joined to a first surface of the third bamboo layer along a second lamination plane substantially parallel to the first lamination plane, wherein the third bamboo layer has a width less than the first bamboo layer, wherein all lamination planes in a cross section perpendicular to a length of the shaft are oriented in the same direction and are substantially parallel, wherein the shaft is configured to receive a lacrosse head, and wherein the first bamboo layer has a thickness between 0.0625 and 0.5 inches.

14. The lacrosse shaft of claim 13, wherein the thickness of the first bamboo layer is between 0.125 and 0.375 inches.

15. The lacrosse shaft of claim 13, wherein the second bamboo layer extends substantially from the first side surface substantially to the second side surface.

16. The lacrosse shaft of claim 13, wherein the third bamboo layer extends substantially from the first side surface substantially to the second side surface.

17. The lacrosse shaft of claim 13, further comprising:

a fourth bamboo layer, wherein a first surface of the fourth bamboo layer is joined to a second surface of the second bamboo layer along a third lamination plane substantially parallel to the first lamination plane.

18. The lacrosse shaft of claim 13, further comprising:

a fifth bamboo layer, wherein a first surface of the fifth bamboo layer is joined to a second surface of the third bamboo layer along a fourth lamination plane substantially parallel to the first lamination plane.

19. The lacrosse shaft of claim 13, wherein one of the first bamboo layer, the second bamboo layer, or the third bamboo layer extends from the first end to the second end.

20. A lacrosse stick comprising:

a lacrosse shaft comprising:

a first end having an octagonal cross-section;

a second end opposite the first end;

a first side surface having a first length along a first edge of the octagonal cross-section;

a second side surface opposite the first side surface, the second side surface having a second length along a second edge of the octagonal cross-section;

a top surface having a third length along a third edge of the octagonal cross-section;

a bottom surface having a fourth length along a fourth edge of the octagonal cross-section, wherein the first and second lengths are longer than the third and fourth lengths; and a first bamboo layer extending substantially from the first side surface substantially to the second side surface, the first bamboo layer having a width between 0.5 and 1.5 inches, wherein a first surface of the first bamboo layer is joined to a first surface of the second bamboo layer along a first lamination plane substantially normal to the first side surface, substantially normal to the first end, and substantially parallel to the top and bottom surfaces, wherein the second bamboo layer has a width less than the width of the first bamboo layer, wherein a second surface of the first bamboo layer is joined to a first surface of the third bamboo layer along a second lamination plane substantially parallel to the first lamination plane, wherein the third bamboo layer has a width less than the width of the first bamboo layer, wherein all lamination planes in a cross section perpendicular to a length of the shaft are oriented in the same direction and are substantially parallel; and a lacrosse head attached to the second end of the lacrosse shaft.

21. A method of manufacturing a lacrosse shaft, the method comprising:

providing a first bamboo layer comprising:

a first end;

a second end opposite the first end;

a first side surface;

a second side surface opposite the first side surface;

a top surface;

a bottom, and a width between 0.5 and 1.5 inches;

providing a second bamboo layer having a width less than the first bamboo layer;

providing a third bamboo layer having a width less than the first bamboo layer;

joining a first surface of the first bamboo layer to a first surface of the second bamboo layer along a first lamination plane substantially normal to the first end, substantially normal to the first side surface, and substantially parallel to the top and bottom surfaces;

joining a second surface of the first bamboo layer to a first surface of the third bamboo layer along a second lamination plane substantially parallel to the first lamination plane, wherein all lamination planes in a cross section perpendicular to a length of the shaft are oriented in the same direction and are substantially parallel;

machining the bamboo layers to produce an octagonal cross-section such that the first side surface has a first length along a first edge of the octagonal cross-section, the second side surface has a second length along a second edge of the octagonal cross-section, the top surface has a third length along a third edge of the octagonal cross-section, the bottom surface has a fourth length along a fourth edge of the octagonal cross-section, and the first and second lengths are longer than the third and fourth lengths.

* * * * *